US007690444B1

(12) United States Patent
Watson et al.

(10) Patent No.: US 7,690,444 B1
(45) Date of Patent: Apr. 6, 2010

(54) HORIZONTAL WATERJET DRILLING METHOD

(75) Inventors: Marshall Charles Watson, Midland, TX (US); Donald W. Raymond, Pleasant Hill, CA (US)

(73) Assignee: ACT Operating Company, Midland, TX (US)

( * ) Notice: Subject to any disclaimer, the term of this patent is extended or adjusted under 35 U.S.C. 154(b) by 10 days.

(21) Appl. No.: 12/276,844

(22) Filed: Nov. 24, 2008

(51) Int. Cl.
*E21D 29/00* (2006.01)
*E03B 3/11* (2006.01)

(52) U.S. Cl. ..... 175/62; 175/61; 175/67; 175/77; 175/81; 166/50

(58) Field of Classification Search ..... 175/61, 175/62, 67, 77–81; 166/50, 313, 117.5, 117.6
See application file for complete search history.

(56) References Cited

U.S. PATENT DOCUMENTS

| | | | | |
|---|---|---|---|---|
| 5,413,184 | A | 5/1995 | Landers | |
| 6,138,777 | A | 10/2000 | Fraim et al. | |
| 6,470,978 | B2 | 10/2002 | Trueman et al. | |
| 6,487,782 | B1 * | 12/2002 | Bond | 33/302 |
| 6,915,853 | B2 * | 7/2005 | Bakke et al. | 166/298 |
| 7,264,048 | B2 * | 9/2007 | Zupanick et al. | 166/245 |
| 7,357,182 | B2 | 4/2008 | Hunt et al. | |
| 7,370,710 | B2 | 5/2008 | Trueman et al. | |
| 2003/0192719 | A1 * | 10/2003 | Nackerud | 175/267 |
| 2005/0034901 | A1 * | 2/2005 | Meyer | 175/393 |

OTHER PUBLICATIONS

Iyoho, A.W., et al., "Petroleum Applications of Emerging High-Pressure Waterjet Technology," Oct. 3-6, 1993, SPE Annual Technology Conference and Exhibition, Houston, TX, 8 pages.
Summers, D.A., et al., "Water Jet Cutting of Sedimentary Rock," Jul. 1972, Journal of Petroleum Technology, 6 pages.
Forman, S.E., et al., "The Mechanics of Rock Failure Due to Water Jet Impingement," Jan. 3, 1973, SPE-AIME Sixth Conference on Drilling and Rock Mechanics, Austin, TX, 9 pages.
Summers, D.A., et al., "Waterjetting Technology," 1995, 1st ed, London: New York: E&FN Spoon. xvi, 23 pages.
Dickinson, W., et al., "Multiple Radials Multiply Recovery," Feb. 12-17, 1995, 6th UNITAR International Conference on Heavy Crude and Tar Sands, Houston, Texas, 9 pages.
Kennerley, T., "Development of a High Pressure Water Jet Drilling System for Coal Seams," Jan. 1990, Thesis for Masters of Engineering Science, University of Queensland, Queensland, Australia, 83 pages.

* cited by examiner

*Primary Examiner*—David J Bagnell
*Assistant Examiner*—Yong-Suk Ro
(74) *Attorney, Agent, or Firm*—Edmonds & Nolte, PC

(57) ABSTRACT

A method of completing a lateral channel in a coal seam using a flexible hose with a waterjet that may be directed down a well casing and into a guide shoe. The guide shoe defines a window configured to open into the coal seam and allow the waterjet to engage the coal seam in a substantially horizontal direction. High pressure fluid is then pumped into the waterjet to make a lateral channel therein, and the flexible hose is rigid enough to allow an operator to manually-move the flexible hose.

19 Claims, 3 Drawing Sheets

HORIZONTAL WATERJET DRILLING METHOD

BACKGROUND OF THE INVENTION

Coalbed Methane (CBM) is a natural gas formed by geological processes in coal seams. CBM consists predominantly of methane and is considered an all-in-one natural gas resource as it serves as the source, reservoir and trap for a vast amount of potential natural gas. Typically, CBM can be found unexploited at relatively shallow depths, and because methane is stored in coal by a different means than conventional gas, more gas per unit volume can be recovered at these shallow depths. CBM may be recovered in several ways but is commonly retrieved by penetrating the borehole casing of an existing oil or gas well at a depth below the Earth's surface, and then boring a lateral channel through an adjacent coal seam using a high pressure waterjet nozzle, or blaster nozzle.

To illustrate, oil and gas wells are typically drilled by the use of rotary drilling equipment vertically into the Earth's strata. The vertically extending well holes generally include a casing usually of mild steel in the neighborhood of 4½" to 8" in diameter, which defines the cross-sectional area of a well for transportation of the oil and gas upwardly to the Earth's surface. However, these vertically extending wells are only useful for removing oil and gas from the general vicinity adjacent to and directly underneath the terminating downward end of the well. Thus, not all of the oil and gas in the pockets or formations in the Earth's strata, at the location of the well depth, can be removed.

Because it is time-consuming and costly to make other vertical drillings parallel and close to the first drill, a variety of means are commonly employed to extend the original well in a radial or horizontal direction. As explained, the most common means includes perforating the casing at a specific depth and then drilling a lateral channel using a high pressure waterjet nozzle. In these operations, high-pressure hoses and waterjets are often required to pass through extremely tight areas to reach the coal seam, seemingly requiring a more flexible, smaller inner-diameter hose that can reduce overall fluid pressures. A reduction in fluid pressure results in inadequate cutting power from the waterjet nozzle and, therefore, reduced drilling capacity. Therefore, it remains desirable to find improved waterjet cutting methods that may be practiced in small areas and yet still allow for substantial high-pressure fluid pumping flow rates.

SUMMARY OF THE DISCLOSURE

The present disclosure relates to an improved method for horizontal drilling into the Earth's strata surrounding a well casing thereby enhancing the production of CBM that commonly flows from the fractures in such formations. More specifically, the present disclosure relates to an improved method for drilling a lateral channel into a coal seam where the combination of a flexible hose and a waterjet is capable of entering the coal seam at short radii without significantly reducing the required cutting fluid pressure.

A method for drilling a lateral channel in a subterranean coal seam adjacent to an existing oil or gas well having a well casing is herein disclosed. The method may comprise the steps of suspending a casing mill at a selected depth in the well casing and milling a section of the casing, thus resulting in a circular perforation in the well casing adjacent to the subterranean coal seam; suspending an underreamer to the circular perforation and reaming-out the circular perforation a distance into the subterranean coal seam; suspending a guide shoe to the circular perforation, wherein the guide shoe defines a window configured to open upon reaching the circular perforation; directing a flexible hose down the well casing and into the guide shoe, wherein the flexible hose terminates at a waterjet having a nozzle in fluid communication with a plurality of forward jets, a plurality of retro jets, and a plurality of radial jets; directing the waterjet through the window and out of the guide shoe in a substantially horizontal direction and into engagement with the subterranean coal seam; and pumping a fluid at a high pressure through the flexible hose and waterjet, whereby the fluid is expelled from the waterjet via the plurality of forward, retro, and radial jets such that jets of high pressure fluid shoots at the subterranean coal formation to make a lateral channel therein.

Also disclosed herein is a method of completing a lateral channel in a coal seam adjacent to an existing oil or gas well casing. The method may comprise providing a flexible hose terminating at a waterjet, wherein the waterjet comprises a nozzle in fluid communication with a plurality of forward jets, a plurality of retro jets, and a plurality of radial jets; directing the flexible hose and waterjet down the well casing and into a guide shoe, wherein the guide shoe defines a window pivotally-coupled to the guide shoe and configured to open in a laterally engaged position within the coal seam; directing the flexible hose and waterjet through the window in a substantially horizontal direction and into engagement with the coal seam, wherein the combination of the flexible hose and the waterjet is configured to turn about 90° in about a 12 in. radius; pumping a fluid at a high pressure through the flexible hose and waterjet, whereby the fluid is expelled from the waterjet via the plurality of forward, retro, and radial jets such that jets of high pressure fluid shoot at the coal formation to make a lateral channel therein; and advancing the waterjet through the lateral channel by either directing the fluid at a high pressure through at least one retro jet to create a forward propulsive force or manually moving the flexible hose.

DETAILED DESCRIPTION

Figure 1:
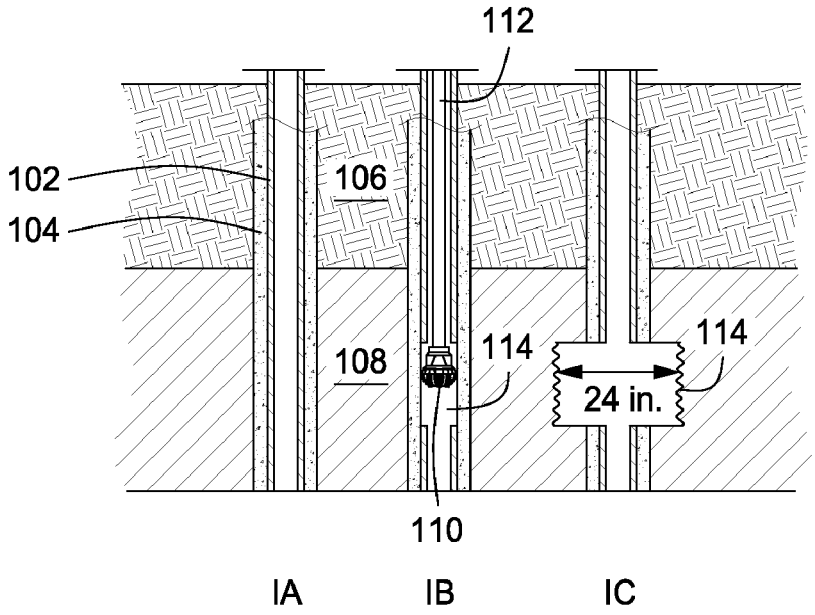
FIG. 1 (PRIOR ART)
FIGS. 1A-1C are side views illustrating progressing operations to perforate a well casing.

Referring now to the drawings in detail, wherein like numbers are used to indicate like elements throughout, there is shown in FIGS. 1A-1C a conventional cement and steel encased oil or gas well, having a steel well casing 102, an annular cement encasement 104, and showing the Earth strata 106 and subterranean coal seam formation 108 beyond. To access the CBM located in the coal seam 108, the well casing 102 and encasement 104 must be perforated. To accomplish this, as illustrated in FIG. 1B, a casing mill 110 may be suspended in the well casing 102 to a selected depth where a coal seam 108 is known to exist. In an alternative embodiment, a permanent or retrievable bridge plug (not shown) may be used to locate the coal seam 108. As explanation, a commercially-available bridge plug, or blanking plug, may first be engaged a certain distance below the selected depth where a coal seam 108 is known to exist. In an exemplary embodiment, the bridge plug may be engaged at about 60 ft. below the location of the known coal seam 108. To locate the coal seam 108, the casing mill 110 may be lowered to contact the bridge plug and then lifted back up about 60 ft. Although a bridge plug may be engaged at any depth below the coal seam 108, the depth volume may serve to collect the subsequent cuttings and particulates resulting from the subsequent drilling operations which typically interfere with normal drilling operations.

In any event, the casing mill 110 may be connected to the distal end of a length of drill string 112, or tubing string, via suitable attachment means conventional in the art. On the surface, the drill string may be connected to a top drive or a reverse unit (not shown) capable of supplying a rotating force and torque needed to excise a section of the casing 102. Alternatively, the required torque may be supplied via a downhole motor as known in the art.

In an exemplary embodiment including a typical 5.5 in. well casing 102, the casing mill 110 blades may be 6.25 in. in diameter, sufficient to perforate well casing 102 and potentially a portion of the surrounding concrete encasement 104. In an exemplary embodiment, the casing mill 110 may include the commercially-available Weatherford A-1 Section mill for 5.5 in. outer diameter well casing 102. In exemplary operation, as the casing mill 110 rotates, its blades continually degrade the well casing 102 about its entire circumference along a 360° path, thus yielding a circular perforation 114 into the well casing 102. In exemplary operation, the casing mill 110 may be gradually lowered to perforate the casing to a height of about 4 ft.

Figure 2:
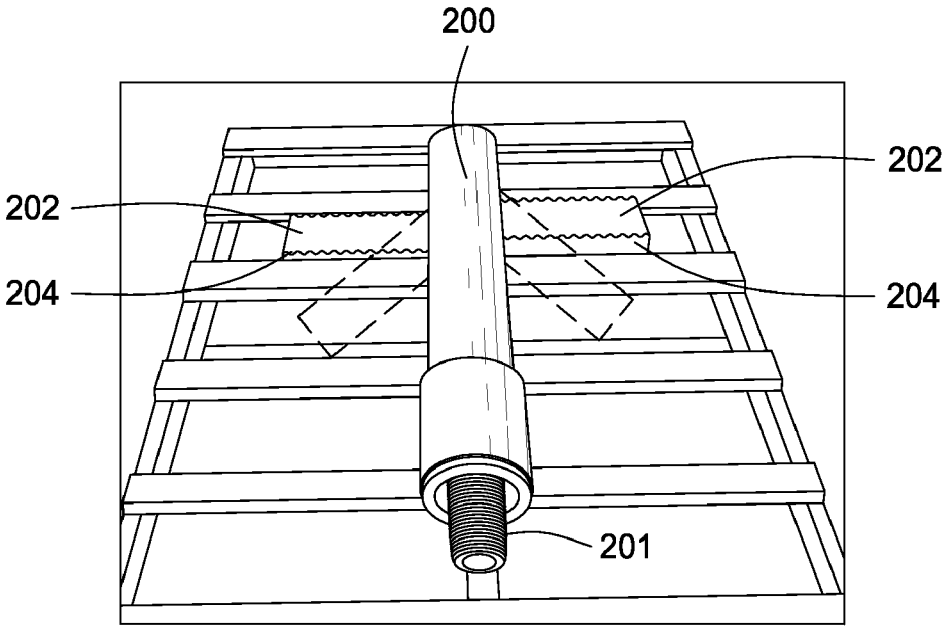
FIG. 2 is a perspective view of an exemplary underreamer according to one or more aspects of the present disclosure.

In an exemplary embodiment, underreaming operations may then be applied to extend and simultaneously enlarge the perforation 114. Suitable underreamer devices are generally available in a variety of closed and open diameter combinations, thus allowing for the presently disclosed methods to be performed in multiple design arrangements. In an exemplary embodiment, the commercially-available Jet Underreamer, manufactured by Harvest Tools, LLC may be employed as a suitable underreamer. FIG. 2 illustrates an exemplary underreamer 200 suitable for the present disclosure.

In an exemplary embodiment of operation, once the casing mill 110 is removed, an underreamer 200 may be lowered to the perforation 114 depth. In alternative embodiments, as described above, a bridge plug may be used to assist in finding the desired depth. As illustrated in FIG. 2, the underreamer 200 may be attached to the distal end of a drill string 112 via a threaded engagement 201 at its base. It may also include a pair of flush-mounted cutting blades 202 that are pivotally connected to the underreamer 200 body. The underreamer 200 and its cutting blades 202 may be manufactured of special alloy steel with high hardness and impact strength. Accordingly, the cutting blades 202 may be capable of cutting through the concrete encasement 104 and a surrounding coal seam formation 108. Moreover, multiple cutting jets 204 may be situated along the length of the cutting blades 202 and configured to provide high-pressure fluidic release also capable of cutting through the coal seam 108. Additional cutting jets (not illustrated) may also be located at the ends of the blades 202 to achieve a larger diameter cavitation or clean-out operations. By design, the cutting blades 202 may pivotally extend outward with respect to the underreamer 200 body in response to hydraulic pressure through the cutting blades 202 and/or the resultant centrifugal forces occurring through high-speed rotation of the drill string 112. In an alternative exemplary embodiment, the underreamer 200 may operate using pressurized air.

In exemplary operation, the underreamer 200 may be capable of removing the cement encasement 104, and also capable of reaming the circular perforation 114 to a diameter of 20-30 in. with respect to the casing 102. As illustrated in FIG. 1C, an exemplary embodiment may include underreaming the perforation 114 to a diameter of about 24 in., and a height of about 4 ft.

Figure 3:
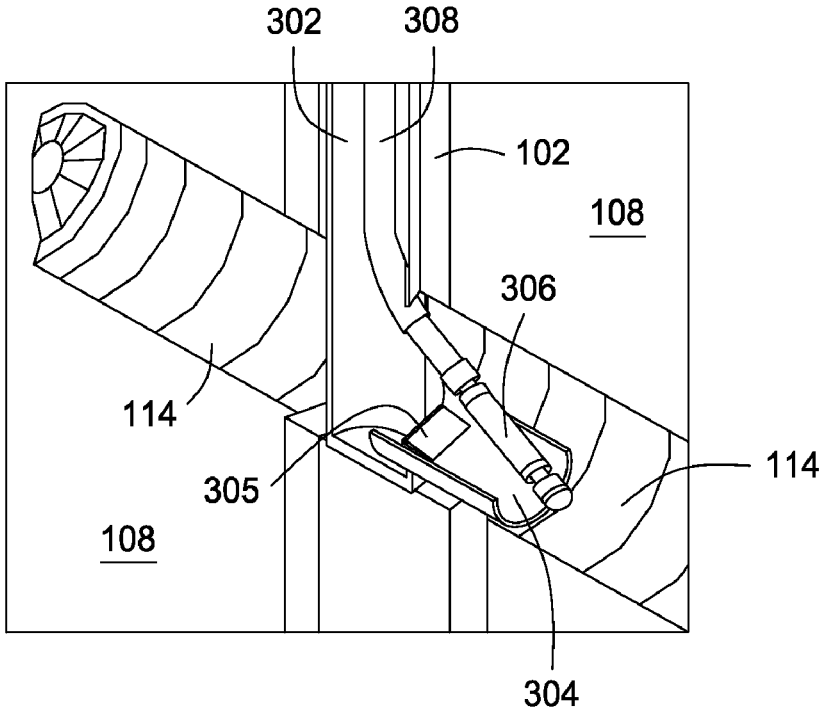
FIG. 3 is a perspective view of drilling illustrating a waterjet and hose combination entering a perforation of a coal seam.

Referring now to FIG. 3, once the underreamer 200 is removed from the borehole, a waterjet guide shoe 302 may be lowered to the known circular perforation 114 depth. Alternatively, as explained above, and to avoid the highly sophisticated and expensive depth-finding equipment commonly employed in similar waterjet drilling operations, the circular perforation 114 depth may be located using a previously engaged bridge plug, or blanking plug (not shown). To locate the circular perforation 114, the waterjet guide shoe 302 may be lowered to contact the bridge plug and then lifted back up about 60 ft. In an alternative embodiment, a length of about 60 ft. of small-diameter tubing (not illustrated) may be coupled to the bottom of the waterjet guide shoe 302. The small-diameter tubing may be configured to stop the descent of the guide shoe 302 at about 60 ft. above the bridge plug, i.e., the circular perforation 114 depth. In alternative embodiments, any type of tubing or rigid member of a similar length with respect to the circular perforation 114 may be used in place of the about 60 ft. of small-diameter tubing. As can be appreciated, in applications where the bridge plug is placed at different depths below the coal seam 108, the exemplary tubing or rigid member may include a length equal to that of the depth below the coal seam 108 for consistency.

Still referring to FIG. 3, as with the mill 110 and underreamer 200, the guide shoe 302 may also be coupled to the distal end of a length of drill string 112 via suitable attachment means. In one embodiment, the guide shoe 302 may be welded to a length of drill string 112, however, the guide shoe 302 may also be threadably attached or attached by another suitable means known in the art. In an exemplary embodiment, the waterjet guide shoe 302 may include a hollow, cylindrical body having a diameter of about 3.5-4 in. The guide shoe 302 may also define a window 304 that is pivotally-coupled, or moveably hinged, to the guide shoe 302 and thereby configured to open in a laterally engaged position within the reamed circular perforation 114 adjacent the severed upper and lower portions of the casing 102. As illustrated, a hinging mechanism 305 may be coupled, or mechanically attached, to the window 304. The mechanism 305 may also be coupled, or mechanically attached, to the lower end of the guide shoe 302, thereby allowing the window to pivotally translate.

In exemplary operation, as the guide shoe 302 is lowered into the casing 102, the hinged window 304 may remain in a substantially closed position due to the sliding bias engagement with the inner wall of the casing 102. Once the guide shoe 302 reaches the circular perforation 114 depth, the window 304 may open laterally via gravitational or mechanical forces, and ultimately open into the perforation 114. Stated differently, because the window 304 is moveably hinged to the guide shoe 302, upon reaching the perforation 114 the window 304 may be configured to either automatically fall into an open position or forced open as a result of a spring-loaded hinge assembly. Once open, the window 304 may provide an exit from the guide shoe 302 into the adjacent coal seam 108. In an exemplary alternative embodiment, cables (not illustrated) may be attached to both the guide shoe 302 and the window 304 and may be configured to stop the gravitational descent of the window 304 at about a 90° angle relative to the casing 102. To remove the guide shoe 302 after operations are completed, the exemplary cables may be broken by the upward movement of the drill string 112 once the window 304 engages the top of the circular perforation 114, thus allowing the hinged window 304 to drop about another 90° and exit the well bore in a substantially downwardly vertical position.

1. In an alternative exemplary embodiment, the hinged window 304 may be mechanically coupled to the exemplary length of about 60 ft. of small-diameter tubing, as described above. In one embodiment, the hinging mechanism 305 on the window 304 may be spring-loaded and configured to constantly apply a closing force to the window 304. In exemplary operation, as the length of about 60 ft. of small-diameter tubing engages the bridge plug located about 60 ft. below the circular perforation 114, the small-diameter tubing may force the spring-loaded window 304 to a substantially open position. In one embodiment, the small-diameter tubing may be configured to force the hinged window 304 open to an angle of about 90° relative to the casing 102. As can be appreciated, once the guide shoe 302 begins its ascent, pressure on the bridge plug may thereby be removed and the hinged window 304 may then return to its closed position as a result of the spring force applied by the hinging mechanism 305.

Still referring to FIG. 3, with the guide shoe 302 in an open position (as illustrated), a waterjet 306, coupled to flexible high-pressure hose 308, may be directed down the drill string 112. In an alternative exemplary embodiment, tubing string (not illustrated), having a diameter of about 2.375 in. or less, may be employed in place of the drill string 112 and configured to prevent the buckling of the high-pressure hose 308 during operations. In an exemplary embodiment, the commercially-available StoneAge® Banshee™ series BN 18 may be employed as a suitable waterjet 306. The BN 18 waterjet 306 consists of a 0.69 in. diameter body with a 0.375 in. inside diameter and a length of 3.8 in.

In an exemplary embodiment, the flexible high-pressure hose 308 may use a "memory curl" to exit the window 304 once lowered to the perforation 114 depth. The memory curl results from the physical properties of the hose 308 that preserve a "curl" after maintaining its end in a curled position for a period of time. Upon reaching the guide shoe 302, the waterjet 306, using the memory curl of the hose 308, may be fed through the window 304 and into the perforation 114 adjacent to the coal seam 108.

Because of the small size of the waterjet 306 and the flexibility of the hose 308, the combination waterjet 306 and hose 308 may pass through a tight radius without sacrificing the required fluid pressure to work effectively. In particular, the waterjet 306 and hose 308 combination may be capable of turning the required approximate 90° corner at the guide shoe 302 window 304 in a radius of about 12 in. as required by the 24 in. reamed-out perforation 114 described above. However, proposed modifications to the StoneAge® line of waterjets 306 will likely shorten the tool, thus enabling it to turn an even shorter radius (e.g., 8 in.), while yet maintaining the required fluid pressures and thrust to effectively complete the drilling operations herein disclosed.

Figure 4:
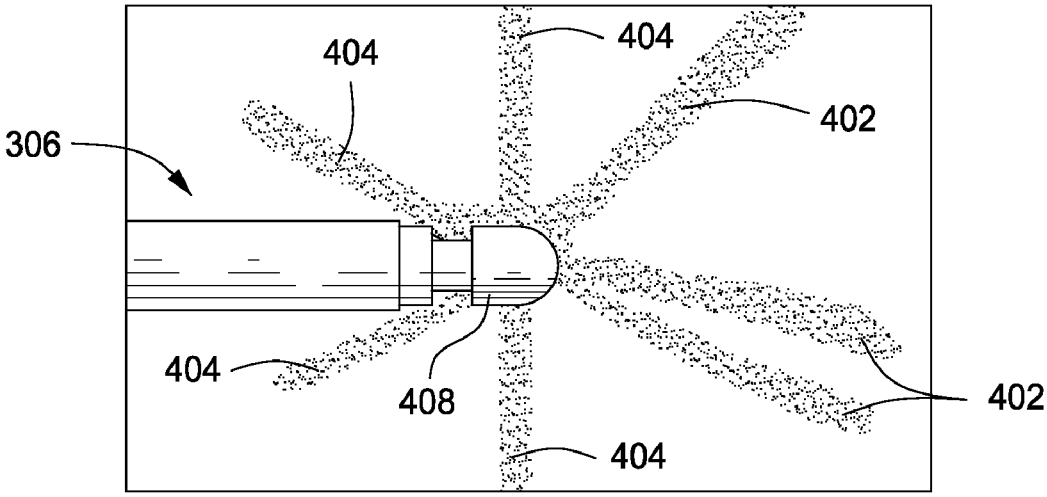
FIG. 4 illustrates an exemplary waterjet according to one or more aspects of the present disclosure.

As illustrated in FIG. 4, an exemplary waterjet 306 may include a self-rotating nozzle 408 in fluid communication with a plurality of forward jets 402, a plurality of retro jets 404, and a plurality of radial jets 406. Applications employing more retro jets 404 than forward jets 402 typically result in a rearward volume differential leaving the operator with less cutting volume at the front of the nozzle 408. As increased forward cutting volume may be desired, exemplary embodiments of the present disclosure may employ more forward jets 402 than retro jets 404. For example, as illustrated in FIG. 4, an exemplary nozzle 408 may include three forward jets 402, two retro jets 404, and two radial jets 406, thus making the forward jets 402 more numerous than the retro jets 404.

Each jet 402, 404, 406 may consist of a channel machined or otherwise formed into the nozzle 408. In an exemplary embodiment, the forward jets 404, generally located on the tip of the self-rotating nozzle 408, may be designed to "cross over" during nozzle 408 rotation to prevent coning of the coal seam 108, as is known in the art. On the other hand, the retro jets 404 may be evenly spaced about the tail end of the nozzle 408 and angled at approximately 140° relative to the waterjet 306 body. The radial jets 406 may be evenly spaced circumferentially around the nozzle 408 and directed substantially perpendicular so as to ream the channel during forward progression.

With the waterjet 306 substantially in engagement with the coal seam 108, fluid maintained at a high pressure may be pumped through the flexible high-pressure hose 308 and into the waterjet 306. In an exemplary embodiment, the waterjet 306 may use a high-pressure drilling fluid, preferably clean water, less preferably some other liquid, for proper operation. The self-rotating nozzle 408, working on a constant-volume process, accelerates the fluid to a higher-velocity in order escape the nozzle 408, thus propelling the fluid into a coherent stream, or jet, directed toward a target surface to be cut.

In an exemplary embodiment of operation, the nozzle 408 may pass a proportion of the fluid into the forward jets 402 and radial jets 406 resulting in the reaming or cutting-away of the adjacent and surrounding coal seam 108. A proportion of fluid may also be passed into the retro jets 404 resulting in a collective forward thrust on the waterjet 306 as the pressurized fluid is constantly biased against the rearward coal seam 108. The retro jets 404 may also serve to remove cuttings and debris from the newly carved orifice in the coal seam 108.

According to an exemplary embodiment of the present disclosure, the high-pressure hose 308, although flexible, may also be rigid enough to allow an operator at the surface to apply a significant downward force to bolster the forward thrust of the waterjet 306. The hose 308 rigidity also allows an operator to manually translate the waterjet 306 back and forth within the coal seam 108 to help flush out drilling particulates.

During exemplary drilling operations, high-pressure hose 308 may be fed continuously from a drum located at the surface until a lateral channel of desired length has been completed in the coal seam 108. At which point the hose 308 may be withdrawn at least to a sufficient extent to withdraw the waterjet 306 from the newly bored lateral channel. If it is desired to complete more than one lateral channel at the same depth, then the guide shoe 302 is simply rotated a distance from the previously completed lateral channel and the process is repeated for a second lateral channel, and a third, and so on. It will be evident that one may complete multiple lateral channels at a given depth without having to repeat a well perforating operation.

In an alternative exemplary embodiment, and in order to maintain the "memory curl" of the hose 308 correctly aligned with the window 304 of the guide shoe 302 (see FIG. 3), after completing a first lateral channel in the coal seam 108, the hose 308 and waterjet 306 may be completely removed from the well bore and reeled back onto a drum located at the surface. If it is desired to complete a second lateral channel at the same depth as the first lateral channel, the guide shoe 302 and the drum may be circumferentially rotated around the well bore an equivalent distance so that the "memory curl" of the hose 308 remains aligned with the window 304 of the guide shoe 302. In an exemplary embodiment, the drum may be located on a trailer that may be repositioned so as to accurately align the hose 308 with the newly positioned guide shoe 302.

Alternatively, in order to keep the window 304 of the guide shoe 302 oriented in a known direction downhole, chalk markings may be used. As explanation, a chalk mark may be made as a reference point at the surface in the direction of the window 304. After making up the first tubing section above the guide shoe 302, creating a first tubing joint, the operator makes sure that the reference point and window 304 are aligned in the same direction. The first joint may then be lowered to the reference point at the surface, and there be marked with chalk as a reference for the second joint. After making up the second tubing joint, the operator assures that the reference point at the surface continues to be aligned with the chalk marking on the first joint. Once aligned, the second joint may then be lowered to the reference point, and there be marked with chalk as a reference for the third joint. This process may be repeated until the guide shoe 302 tags a bridge plug in the hole and the tubing is then raised to the exact depth desired to drill, as explained above. In the alternative, the aligned tubing may be run to the exact drilling depth, if known.

In yet another exemplary embodiment, the window 304 of the guide shoe 302 may be oriented for drilling in a known direction downhole by using a known compass measurement. As explanation, if it is desired to drill in a due-eastward direction, an operator at the surface may first align the window 304 in the east direction with the aid of a compass. After making up the first tubing section above the guide shoe 302, creating a first tubing joint, the operator makes sure that the window 304 remains aligned in the east direction. The first joint may then be lowered to the surface and there be marked with chalk in a due-eastward direction. Once a second tubing section is made up, creating a second tubing joint, the operator again assures that the chalk marking on the first joint continues to point in the east direction. Once aligned, the second joint may then be lowered to the surface and there be marked with chalk in a due-eastward direction. This process may be repeated until the guide shoe 302 tags a bridge plug in the hole and the tubing is then raised to the exact depth desired to drill, as explained above. In the alternative, the aligned tubing may be run to the exact drilling depth, if known.

Applicants have reached and applied several conclusions that optimize horizontal coal seam drilling methods. Such conclusions are detailed extensively in the Ph.D. dissertation in petroleum engineering entitled "Optimizing Coalbed Methane Production in the Illinois Basin," authored by Marshall Charles Watson, B.S., M.S. and submitted to the Graduate Faculty of Texas Tech University in May 2008. The dissertation is hereby incorporated by reference in its entirety to the extent that it is not inconsistent with the present disclosure. By way of explanation, and without being bound by any theory, a few of the optimizations reached in the incorporated dissertation are as follows:

In an exemplary embodiment, the method of the present disclosure may be carried out at a depth of about 500-1200 ft. downhole, and extend to lengths reaching about 700-900 ft. horizontally from the well casing 102. Generally, any suitable waterjet 306 and high-pressure hose 308 combination can be used so long as the waterjet 306 and hose 308 can negotiate the approximate 90° turn in the approximate 12 in. radius. Intuitively, however, the high-pressure hose 308 should have an inner diameter as large as possible to minimize pressure losses and yet maintain the flexibility to turn the approximate 90° corner required to enter the reamed-out perforation 114.

In an exemplary embodiment of operation, the high-pressure hose 308 may have a working pressure rating to withstand about 20-40 GPM (gallons per minute), preferably about 30 GPM (gallons per minute), at about 8,000-12,000 psi pump pressure, preferably about 10,000 psi pump pressure. Therefore, the hose 308 may be capable of delivering about 8,000-10,000 psi, preferably about 9000 psi, to the nozzle 408 after total line losses.

Figure 5:
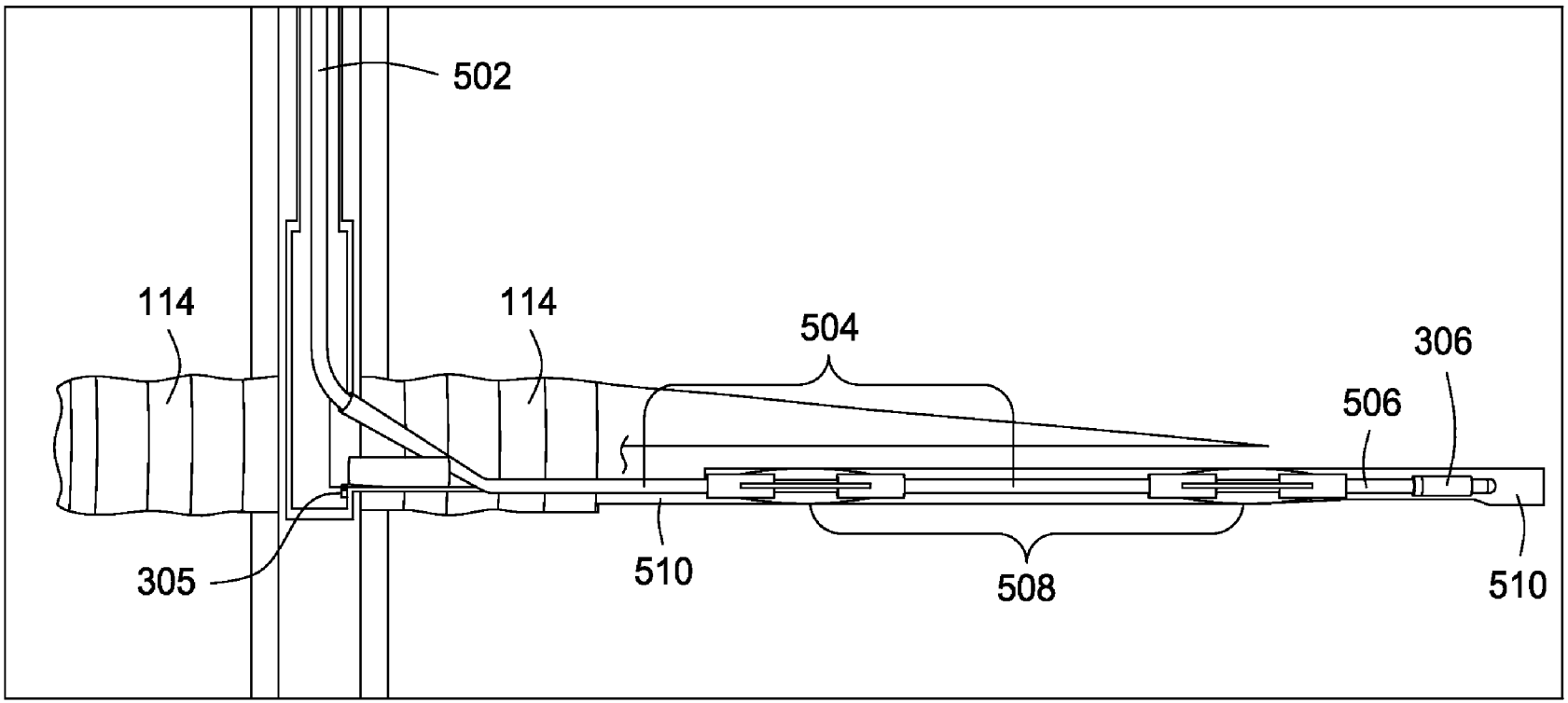
FIG. 5 is a side view of drilling a lateral channel in a coal seam according to one or more aspects of the present disclosure.

As illustrated in FIG. 5, an exemplary embodiment may include employing at least three disparate sections of high-pressure hose 308 (collectively 502, 504, 506), each having a different length and possibly a different inner diameter. High-pressure couplings (not illustrated) may be used to connect the first hose section 502 to the second hose section 504, and the second hose section 502 to the third hose section 506. Generally, any commercially-available high-pressure coupling may be used to connect the different sections (502, 504, and 506), and in most applications, suitable couplings may be acquired from the manufacturer of the waterjet 306.

In an exemplary embodiment, the first hose section 502 may originate at the surface and extend up to a length of about 900 ft. with an inner diameter of about 1.00 in. The second hose section 504 may be coupled to the first hose section 502 and extend up to about 700 ft. with an inner diameter of about 0.75 in. The third hose section 506 may include an inner diameter of about 0.375 in., extending up to about 10 ft. and coupled to the second hose section 504 at one end and to the waterjet 306 at its opposite end.

It has been shown that the commercially-available Power Track™ and SpirStar™ hoses meet the above-noted pressures and delivery criteria. In particular, by pumping about 30 GPM at a high pressure of about 10,000 psi surface pressure, a pressure loss of about 196 psi may result through about 900 ft. of 1.00 in. diameter Power Track™ hose acting as the first hose section 502. Moreover, a pressure loss of about 643 psi may result through about 700 ft. of 0.75 in. diameter SpirStar™ hose acting as the second hose section 504. Lastly, a pressure loss of about 255 psi may result through about 10 ft. of 0.375 in. diameter SpirStar™ hose acting as the third hose section 506. Therefore, a total pressure loss of about 1094 psi may be experienced, leaving approximately 9000 psi in fluid pressure needed to operate the waterjet 306 at desired operating conditions.

Also illustrated in FIG. 5 is a plurality of centralizers 508 that may be attached to the hose 308 (collectively 504 and 506) at increments of about 5 to 6 ft. The centralizers 508 may be made of a flexible material, such as aluminum or rubber, and clamped to the hose 308 with commercially-available friction clamps. In an exemplary embodiment, the centralizers 508 may ride on the bottom and top of the lateral channel 510 to keep the hose 308 (collectively 504 and 506) centrally located within the lateral channel 510. Thus, the centralizers 508 may maintain the drilling operation in a straight course and allow for improved flushing-out of the cuttings and particulates generated from the drilling.

Furthermore, because of the rigidity of the hose 308 (collectively 502, 504, 506), an operator on the surface may be able to manually manipulate the waterjet 306, thereby compensating for the lack of forward thrust as a result of less numerous retro jets 404. For example, at the above-noted lengths and diameters of hose 308 (collectively 502, 504, and 506), the retro jets 404 on the StoneAge® Banshee™ series BN 18 waterjet 306 may generate approximately 60 lbs. of forward thrust. However, this may not be enough thrust to advance the waterjet 306 by overcoming the forward volume differential originating from the more numerous forward jets 402. Instead, because of the rigidity of the hose 308 (collectively 502, 504, 506), a downward force on the hose 308 may be manually-applied to assist the less-numerous retro jets 404 with forward thrust. Thus, an operator at the surface is capable of providing the maximum amount cutting force from the more numerous forward jets 402, while not relying solely on the forward thrust of the less numerous retro jets 404.

Additionally, because of the rigidity of the hose 308 (collectively 502, 504, 506), an operator at the surface may manually translate the waterjet 306 back and forth within the lateral channel 510. Indeed, while riding on the centralizers 508, the hose 308 may be manually reciprocated back and forth to not only increase forward thrust, but also to flush out drilling particulates.

It will be understood that the dimensions and proportional structural relations shown in the drawing figures are for exemplary purposes only, and that the figures do not necessarily represent actual dimensions or proportional structural relationships used in the methods herein described.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired Earth retaining structures. Therefore, the claims should be interpreted in a broad manner, consistent with the present disclosure.

We claim:

1. A method for drilling a lateral channel in a subterranean coal seam adjacent to an existing oil or gas well having a well casing, comprising:

suspending a casing mill at a selected depth in the well casing and milling a section of the well casing, thus resulting in an annular perforation in the well casing adjacent to the subterranean coal seam;

suspending an underreamer to the circular perforation and reaming-out the annular perforation a distance into the subterranean coal seam;

suspending a guide shoe in the well to the annular perforation, wherein the guide shoe defines a window configured to open upon reaching the annular perforation;

directing a flexible hose down the well casing and into the guide shoe, wherein the flexible hose terminates at a waterjet having a nozzle in fluid communication with a plurality of forward jets, a plurality of retro jets, and a plurality of radial jets;

directing the waterjet through the window and out of the guide shoe in a substantially horizontal direction and into engagement with the subterranean coal seam;

pumping a fluid at a high pressure through the flexible hose and waterjet, whereby the fluid is expelled from the waterjet via the plurality of forward, retro, and radial jets such that jets of high pressure fluid shoots at the subterranean coal formation to make a lateral channel therein; and translating the flexible hose back and forth manually within the lateral channel to advance the waterjet and flush out drilling particulates.

2. The method of claim 1, wherein the annular perforation is milled to a height of about 4 ft. by the casing mill.

3. The method of claim 1, wherein the underreamer comprises at least a pair of flush-mounted cutting blades pivotally connected to the underreamer, wherein the cutting blades have multiple cutting jets situated thereon and are configured to hydraulically and/or mechanically penetrate the annular perforation and cut into the subterranean coal seam.

4. The method of claim 1, wherein the underreamer is capable of reaming the annular formation to a diameter of about 24 in.

5. The method of claim 1, wherein the window of the guide shoe is pivotally-coupled to the guide shoe and thereby configured to open in a laterally engaged position within the annular perforation.

6. The method of claim 1, wherein the step of suspending a casing mill at a selected depth in the well casing is preceded by the step of engaging a bridge plug a distance below the subterranean coal seam, whereby the bridge plug is used to locate the subterranean coal seam.

7. The method of claim 1, wherein the nozzle further comprises a rotatable fluid cutting nozzle.

8. The method of claim 1, wherein the forward jets are configured to cross over during operation to prevent coning and the retro jets are rearwardly angled at approximately 140° relative to the waterjet.

9. The method of claim 1, wherein the plurality of forward jets are more numerous than the plurality of retro jets.

10. The method of claim 1, wherein a combination of the waterjet and the flexible hose is configured to turn about 90° in about a 12 in. radius.

11. The method of claim 1, wherein the flexible hose entering the lateral channel further comprises a plurality of centralizers coupled to the flexible hose and configured to centrally locate the flexible hose within the lateral channel, thereby allowing for improved flushing-out of cuttings and particulates.

12. A method of completing a lateral channel in a coal seam adjacent to an existing oil or gas well casing, comprising:

providing a flexible hose terminating at a waterjet, wherein the waterjet comprises a nozzle in fluid communication with a plurality of forward jets, a plurality of retro jets, and a plurality of radial jets;

directing the flexible hose and waterjet down the well casing and into a guide shoe, wherein the guide shoe defines a window pivotally-coupled to the guide shoe and configured to open in a laterally engaged position within the coal seam;

directing the flexible hose and waterjet through the window in a substantially horizontal direction and into engagement with the coal seam, wherein the combination of the flexible hose and the waterjet is configured to turn approximately 90° relative to the well casing in about a 12 in. radius;

pumping a fluid at a high pressure through the flexible hose and waterjet, whereby the fluid is expelled from the waterjet via the plurality of forward, retro, and radial jets such that jets of high pressure fluid shoot at the coal formation to make a lateral channel therein; and advancing the waterjet through the lateral channel by either directing the fluid at a high pressure through at least one retro jet to create a forward propulsive force or manually moving the flexible hose.

13. The method of claim 12, further comprising manually-translating the flexible hose back and forth within the lateral channel to increase forward thrust and flush out drilling particulates.

14. The method of claim 12, further comprising directing the flexible hose and waterjet through the window and into engagement with the coal seam, wherein the combination of the flexible hose and the waterjet is configured to turn about 90° in about an 8 in. radius.

15. The method of claim 12, wherein the nozzle further comprises a rotatable fluid cutting nozzle.

16. The method of claim 12, wherein the plurality of forward jets are more numerous than the plurality of retro jets.

17. The method of claim 12, wherein the forward jets are configured to cross over during operation to prevent coning and the retro jets are rearwardly angled at approximately 140° relative to the waterjet.

18. The method of claim 12, wherein the flexible hose entering the lateral channel further comprises a plurality of centralizers coupled to the flexible hose and configured to centrally locate the flexible hose within the lateral channel, thereby allowing for improved flushing-out of cuttings and particulates.

19. The method of claim 12, wherein the guide shoe comprises a hollow, cylindrical body having a diameter of about 3.5 to about 4 in.

* * * * *